US007494312B2

(12) United States Patent
Valette et al.

(10) Patent No.: US 7,494,312 B2
(45) Date of Patent: Feb. 24, 2009

(54) MATERIALS HANDLING AND LIFTING APPLIANCE WITH BOARD HOLDER TILTING DEVICE

(75) Inventors: Christophe Valette, Saint Bonnet de Cray (FR); Jean-Marc Bailly, Ambierle (FR); Denis Narelli, Saint Haon le Chantel (FR); Roger Arese, L'Isle sur Sorgue (FR)

(73) Assignee: Roger Mondelin S.A., Ambierle (FR)

( * ) Notice: Subject to any disclaimer, the term of this patent is extended or adjusted under 35 U.S.C. 154(b) by 196 days.

(21) Appl. No.: 11/227,453

(22) Filed: Sep. 15, 2005

(65) Prior Publication Data

US 2006/0065796 A1 Mar. 30, 2006

(30) Foreign Application Priority Data

Sep. 24, 2004 (FR) ..... 04 52150

(51) Int. Cl.
*B62B 3/04* (2006.01)
*B62B 3/10* (2006.01)
*B62B 3/12* (2006.01)

(52) U.S. Cl. ..... 414/11; 414/444; 414/450; 280/79.7

(58) Field of Classification Search ..... 414/11, 414/444, 450–452, 490; 280/79.7; 33/712
See application file for complete search history.

(56) References Cited

U.S. PATENT DOCUMENTS

| | | | | |
|---|---|---|---|---|
| 920,826 | A * | 5/1909 | Copeland | 414/450 |
| 2,798,297 | A * | 7/1957 | Bodle et al. | 33/712 |
| 3,467,261 | A | 9/1969 | Jewell | 214/1 |
| 3,540,753 | A * | 11/1970 | Hanson | 280/47.34 |
| 5,322,403 | A * | 6/1994 | Herde | 414/11 |
| 5,409,028 | A * | 4/1995 | Lee | 135/66 |
| 6,092,296 | A * | 7/2000 | Nelle | 33/706 |
| 6,244,810 | B1 * | 6/2001 | Reyes | 414/11 |
| 6,893,201 | B2 * | 5/2005 | Clery | 414/490 |
| 7,121,015 | B2 * | 10/2006 | Boge | 33/707 |
| 2003/0127834 | A1 * | 7/2003 | Click | 280/651 |
| 2003/0190219 | A1 * | 10/2003 | Young | 414/11 |

FOREIGN PATENT DOCUMENTS

| | | | |
|---|---|---|---|
| DE | 20109856 | | 4/2002 |
| EP | 0326505 | A2 * | 8/1989 |
| EP | 0777021 | | 6/1997 |
| FR | 2623546 | | 11/1987 |

* cited by examiner

*Primary Examiner*—James Keenan
(74) *Attorney, Agent, or Firm*—Heslin Rothenberg Farley & Mesiti P.C.

(57) ABSTRACT

A materials handling and lifting appliance for a board or panel holder comprises, on a mast, telescopic elements controlled by a winch, and a device for articulating the board or panel holder articulatedly mounted on a shaft relative to a structure connected to the upper end of the telescopic elements at the upper end of the mast. The articulating device includes a support base shaped and designed to accommodate tilting of the holder into a horizontal, intermediate or vertical position. The board holder or panel holder is designed with a carrying arm, the length of which can be adjusted depending on the dimensions of the boards or panels to be picked up and positioned. The carrying arm includes handlebars fitted with control handles and mechanisms for controlling locking and unlocking of the articulating device. The handlebars facilitate tilting the board holder or panel holder into horizontal, intermediate or vertical positions.

12 Claims, 10 Drawing Sheets

MATERIALS HANDLING AND LIFTING APPLIANCE WITH BOARD HOLDER TILTING DEVICE

CROSS REFERENCE TO RELATED APPLICATIONS

This application claims priority from French patent application no. 0452150, filed on Sep. 24, 2004, the entire contents of which is hereby incorporated by reference herein.

BACKGROUND OF THE INVENTION

The present invention relates to the field of materials handling and lifting appliances that can be used in the construction industry in order to offer up boards made of any material in order to build suspended ceilings or fit them under the slope of a roof and on partition walls.

For many years, the Applicant has developed appliances of this type that are intended to hold rectangular-shaped plasterboards or plaster panels or boards and panels made of other materials having large dimensions as much as three meters or more in length and which are therefore very heavy. These boards, thanks to appliances of the above-mentioned type, are then offered up horizontally thanks to a winch mechanism and by means of tilting, so that they can be fixed to the ceiling that is to be covered. Appliances have been developed on the basis of the teaching of Patents FR 2758150, 2780428 and 0314096. In particular, the latter makes provision for using a fixed support section which is offset relative to the mast part and accommodates at its end a means of articulating the device that supports the board or panel, said device including a support base capable of tilting from a horizontal locked position into a vertical one, the intermediate position corresponding to loading the panel or board holder or fitting them on an inclined surface.

The appliances that are the subject of Patents FR 2.758.150 and FR 2.780.428 are extensively operated by the Applicant with considerable commercial success.

However, as part of its research and in order to supplement Patent FR 0314096, the Applicant has optimised the design of the appliance still further by making it easier for the operator to handle boards and panels in positions when they are picked up and offered up onto different surfaces, horizontally in the case of ceilings and vertically in the case of partition walls.

Another objective was also to provide the appliance with a simple means of adapting the position of the tilting device depending on the length of the boards or panels which measure 2 to 3 meters or more.

BRIEF SUMMARY OF THE INVENTION

The aim was therefore to devise and design the lifting appliance to allow flexible, effortless positional adjustment by said operator.

The lifting appliance that is the subject of the invention satisfies all these objectives and constraints.

According to a first aspect of the invention, the materials handling and lifting appliance for a board and panel holder of the type comprising, on a mast, telescopic elements controlled by a winch, a device for articulating the board or panel holder articulatedly mounted on a shaft relative to a means connected to the upper end of the telescopic element at the upper end of the mast, said articulating device comprising a support base shaped and designed to accommodate means allowing it to be tilted into a horizontal, intermediate or vertical position is distinctive in that the board holder or panel holder is fitted with a carrying arm the length of which can be adjusted depending on the dimensions of the boards or panels to be picked up and positioned and in that the carrying arm includes a means of gripping in the form of handlebars fitted with control handles and means of controlling locking and unlocking of the articulating device, the handlebars constituting the means of tilting the board holder or panel holder into position in its horizontal, intermediate and vertical positions.

BRIEF DESCRIPTION OF THE VARIOUS VIEWS OF THE DRAWINGS

The objective of the present invention is described, merely by way of example, in the accompanying drawings in which.

DETAILED DESCRIPTION

Figure 1:
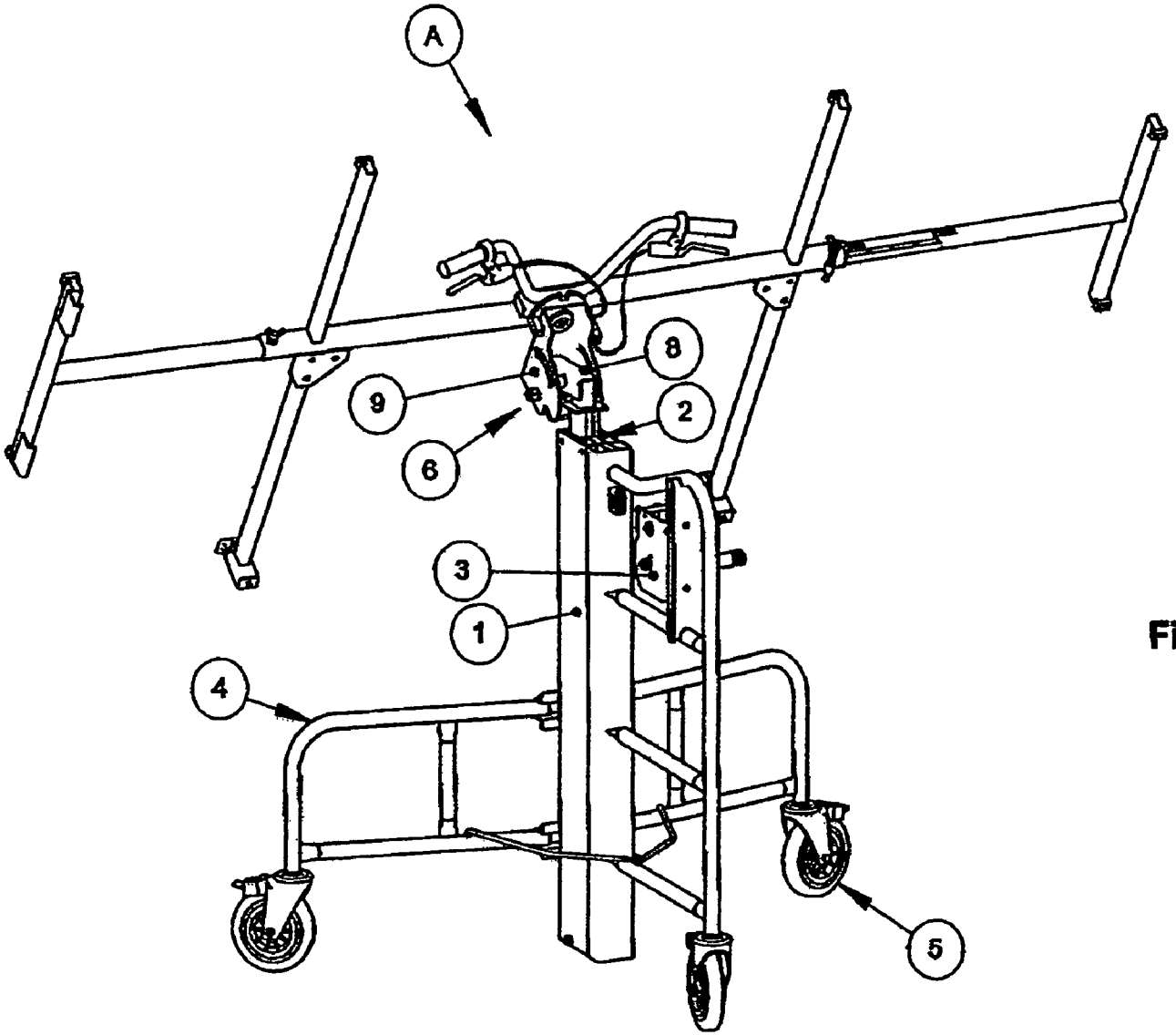
FIG. 1 is a rear perspective view of said appliance in its loading position.
Figure 2:
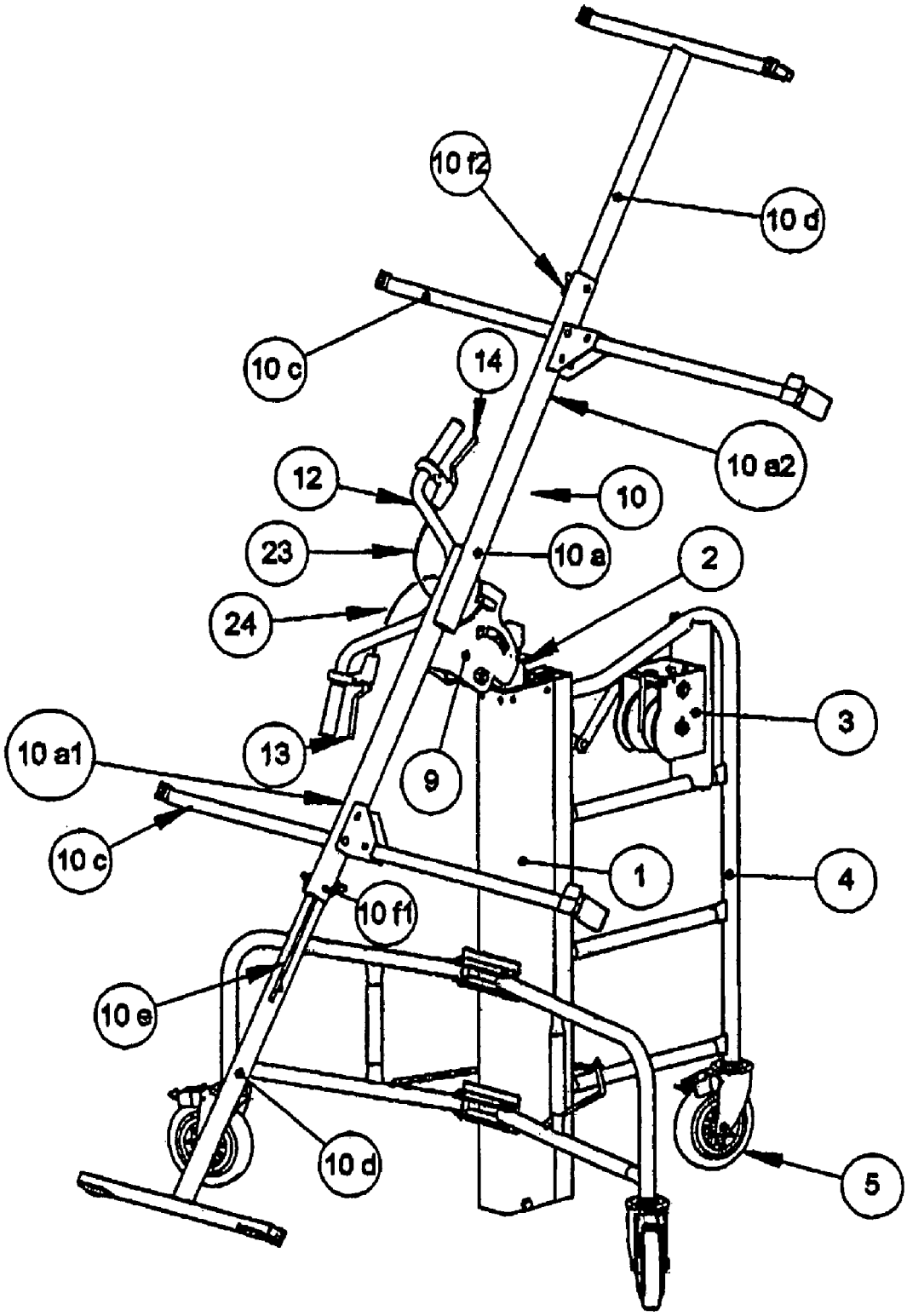
FIG. 2 is a front perspective view of the board handling and lifting appliance according to the invention with the board holder in a sloping position for fitting boards vertically.
Figure 3:
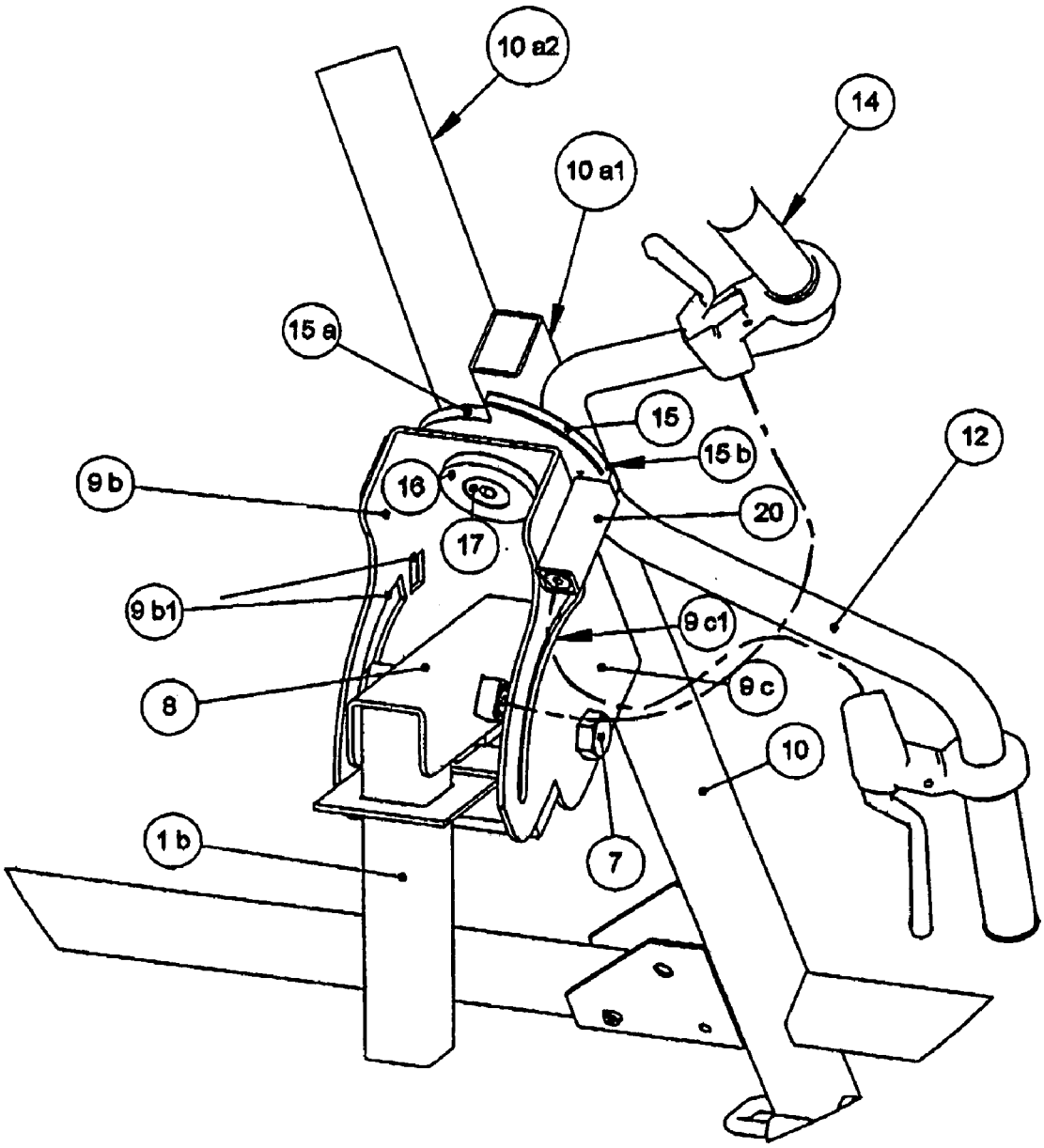
FIG. 3 is a large-scale perspective rear side view of the device for rotating the panel support base.
Figure 4:
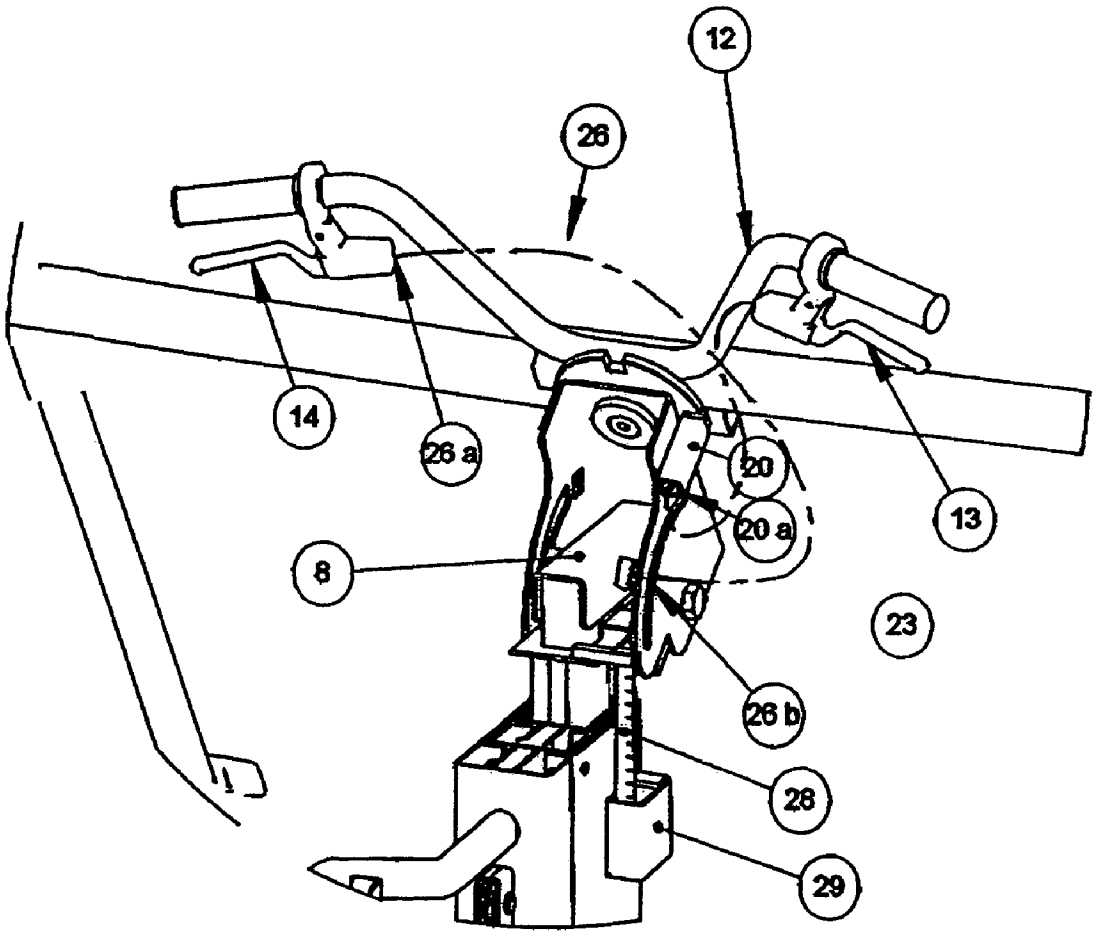
FIG. 4 is another large-scale perspective rear side view of said device.
Figure 5:
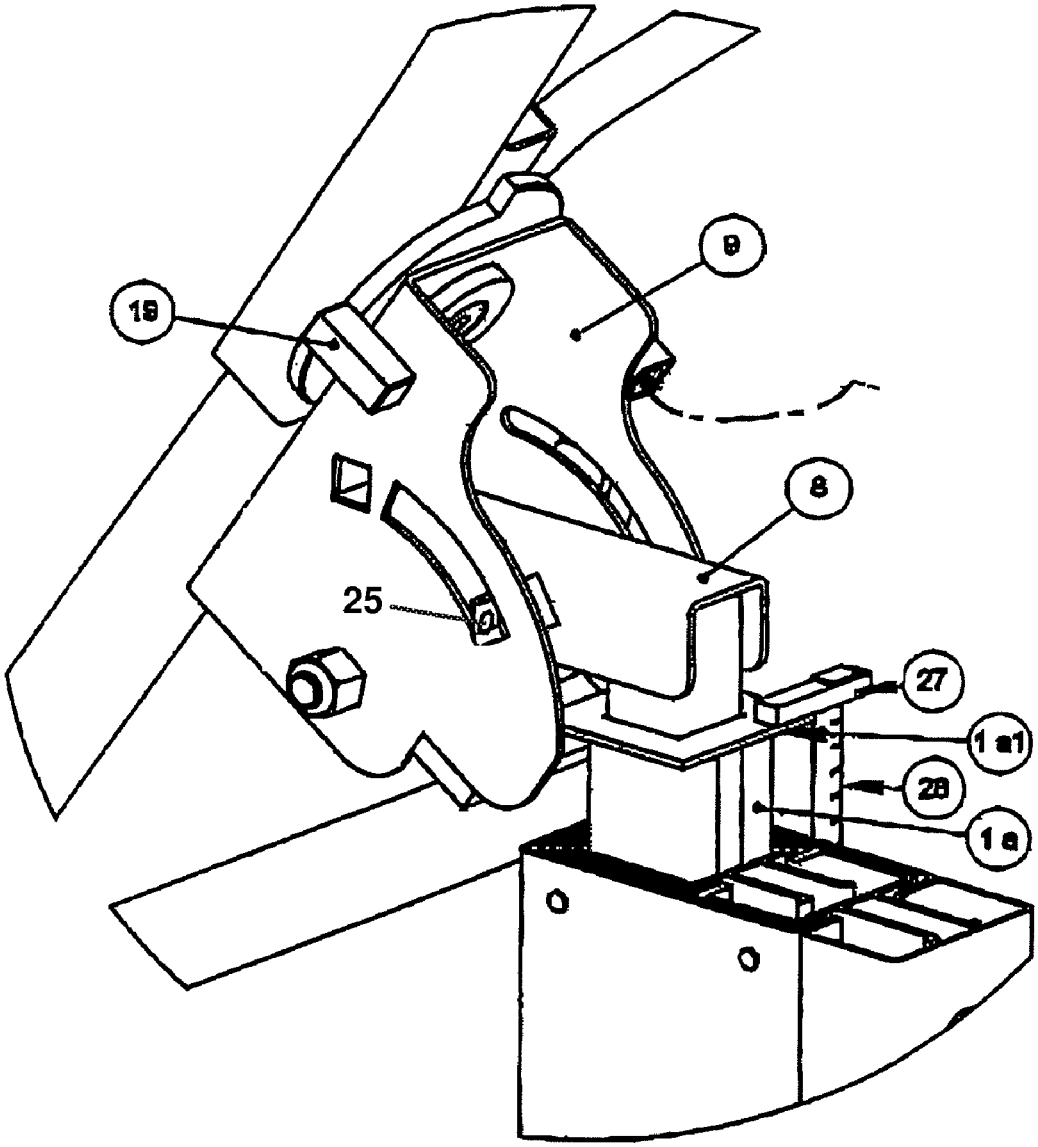
FIG. 5 is a large-scale perspective rear side view showing the raising of the tilting device.
Figure 6:
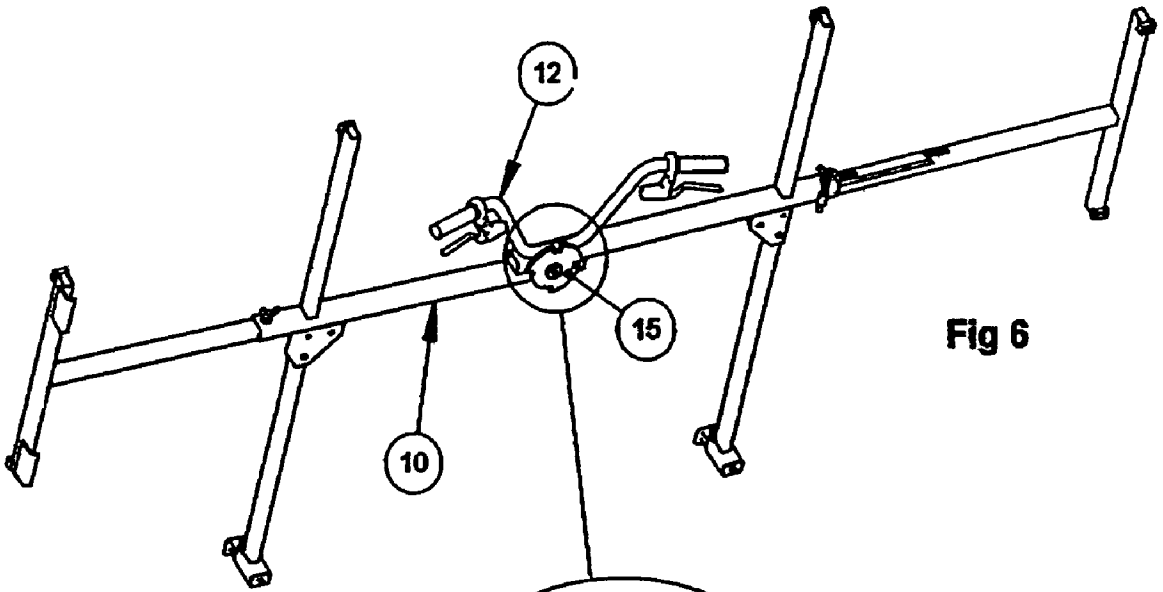
FIG. 6 is a view of the materials carrier on its own, not mounted on the tilting device.
Figure 6A:
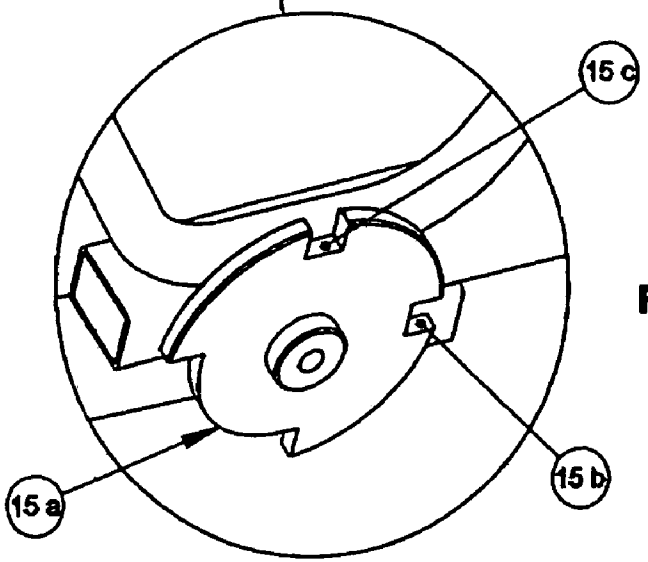
FIG. 6A is a detailed large-scale view in a circle showing a limit stop means.
Figure 7:
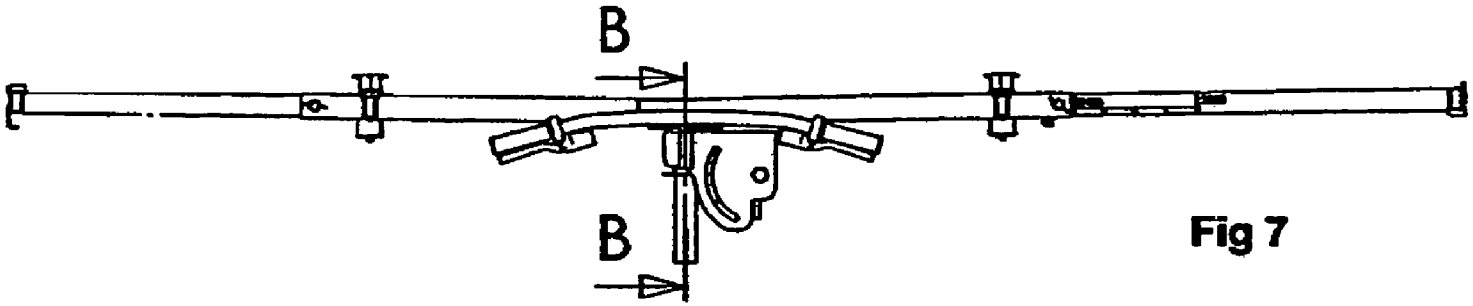
FIG. 7 is a partial view of the materials carrier assembly mounted on the articulating device.
Figure 7A:
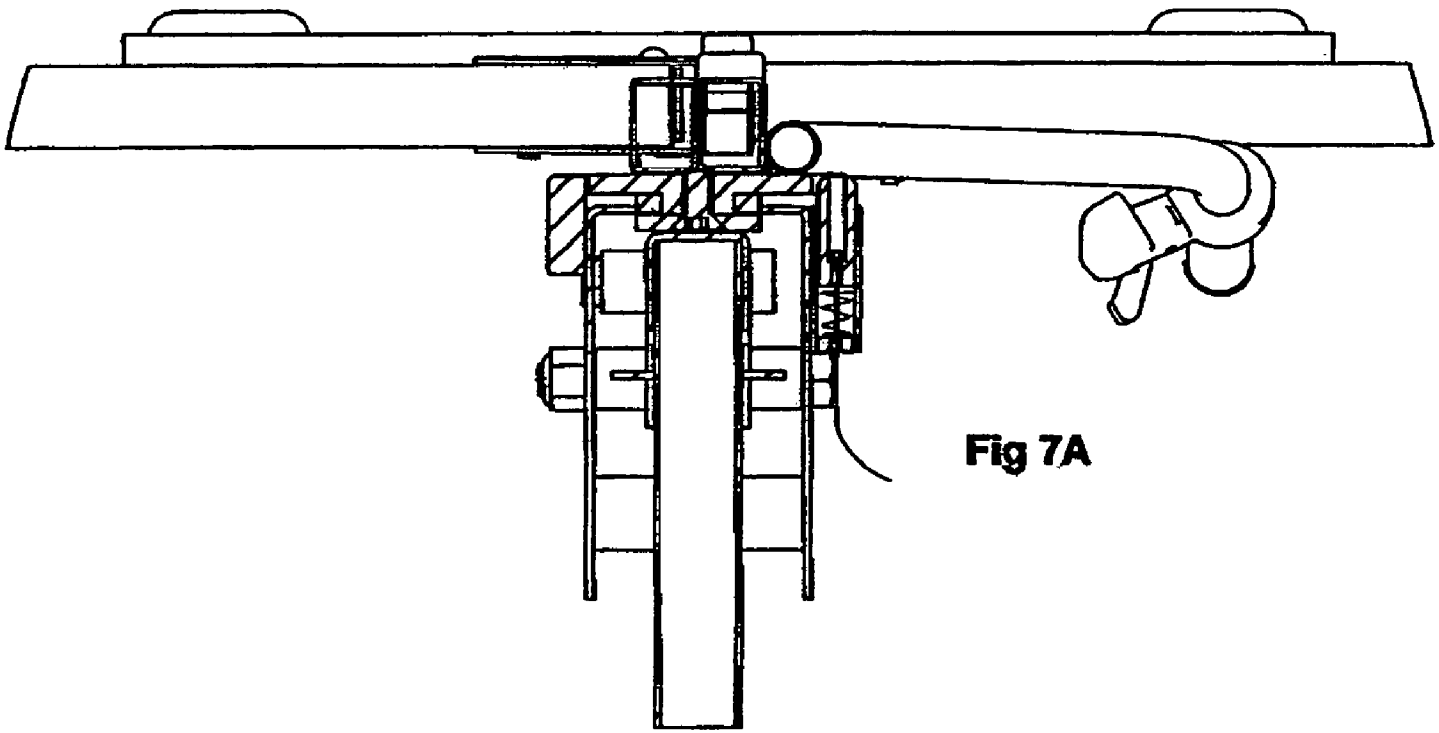
FIG. 7A is a partial cross-sectional view along line B-B in FIG. 7.
Figure 8:
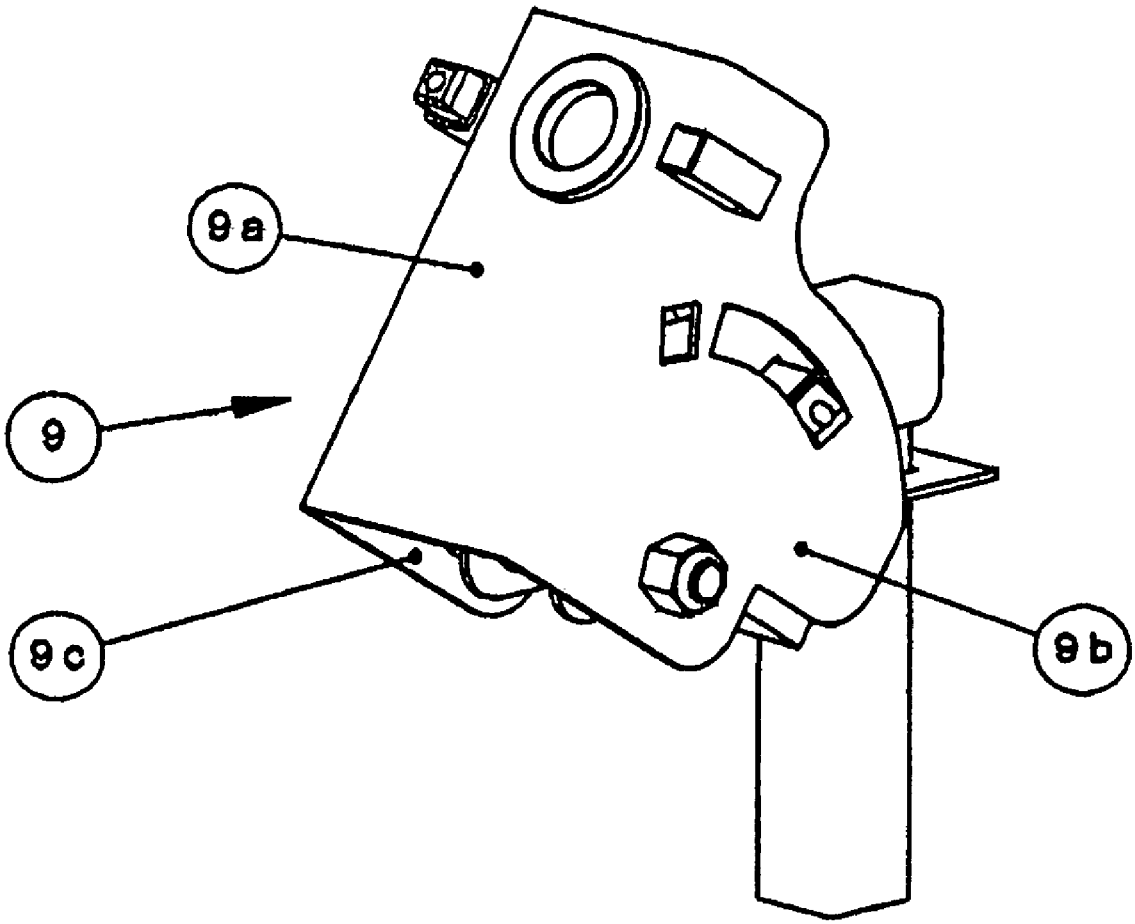
FIG. 8 is a partial perspective view of the support base.
Figures 9, 9A, 9B, 9C:
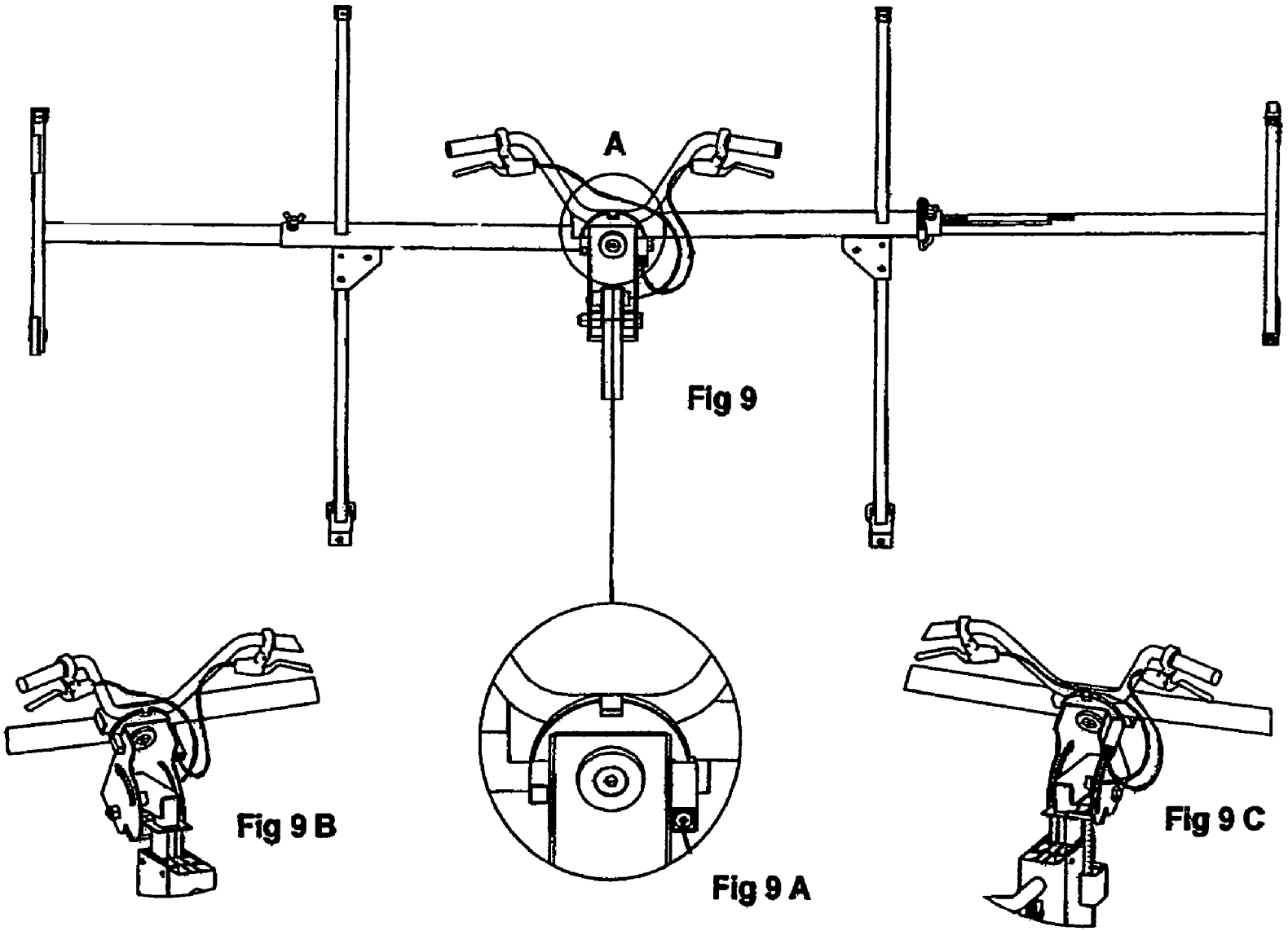
FIG. 9 is a plan view of the materials carrier assembly mounted on the articulating device.
FIG. 9A is a large-scale detailed view of the part in the circle in FIG. 9.
FIG. 9B is a partial perspective view on the limit stop side.
FIG. 9C is a perspective partial view on the positioning lock side.
Figure 10:
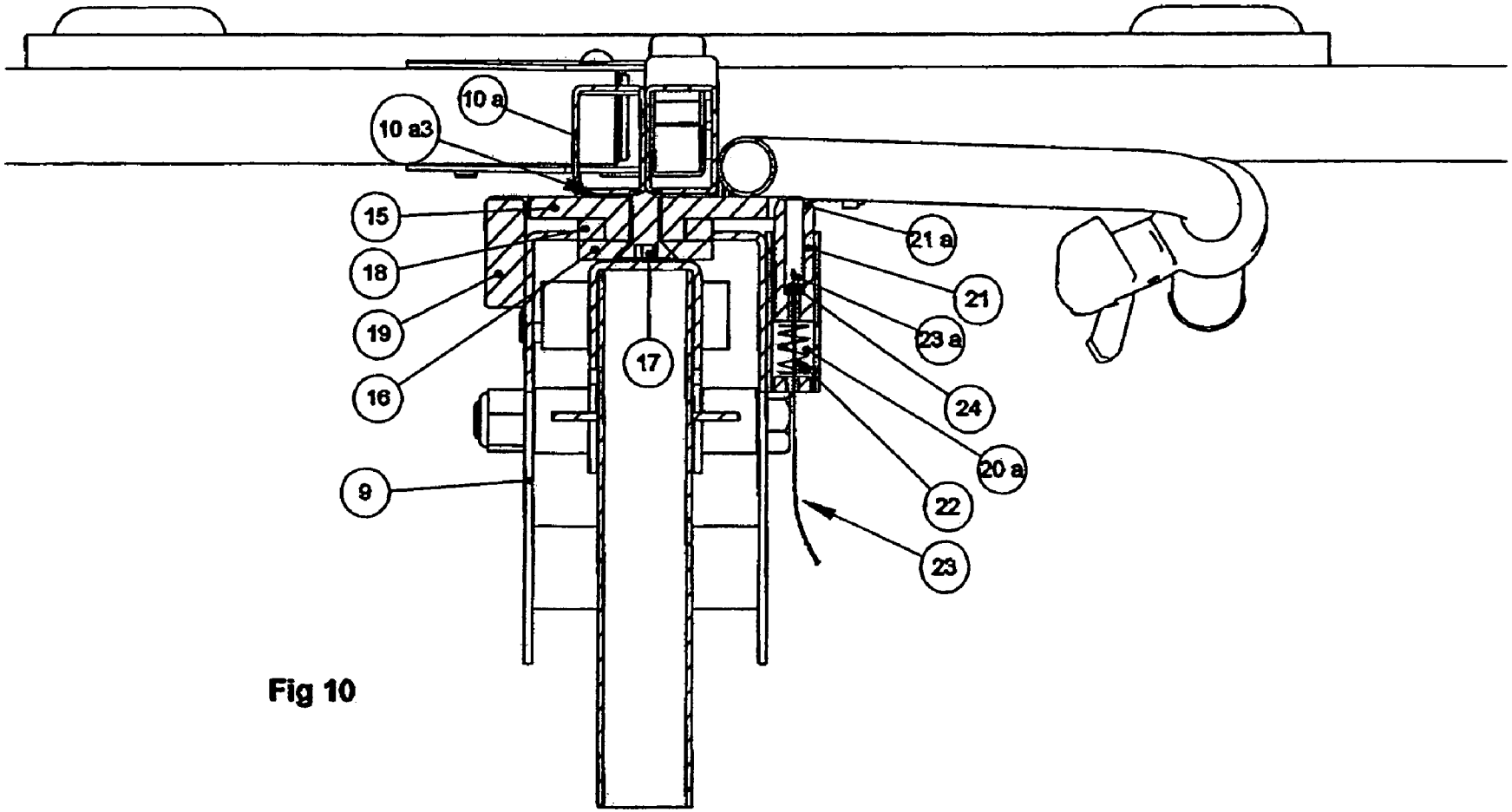
FIG. 10 is a partial cross-sectional view of the articulating device.

In order that the present invention may more readily be understood, the following description is given, merely by way of example, reference being made to the accompanying drawings.

The materials handling and lifting appliance for boards and panels is referred to in its entirety as (A). In a known manner, it comprises a mast (1) forming a vertical safety gear case inside which there are telescopic elements (2) capable of being successively raised by a control winch (3). Legs (4) with rolling means (5) allow the appliance to be moved and ensure that it is stable.

The appliance comprises a board or panel holder articulating device referred to in its entirety as (6) articulatedly fixed to a shaft (7) relative to a fixed horizontal section (8) forming a bar which is itself joined to a tube (1*b*) which in turn fits into the upper end of the telescopic element at the upper end of the appliance's mast (1). This device comprises a support base (9) having a very wide flat upper wall (9*a*) that is used for support and attachment to the framework of the board holder or panel holder (10). Support base (9) has two parallel side pieces (9*b*-9*c*) that are at right angles to the flat upper wall and enclose the fixed section (8) so as to constitute a yoke. Said fixed horizontal section (8) protrudes relative to mast (1) and is considerably offset in order to allow 90° tilting of the board holder or panel holder.

Each of the side pieces (9*b*-9*c*) have a curved oblong slot (9*b*1-9*c*1), one of said slots (9*b*1) having several anchoring points that correspond to different inclinations as described in Patent Application FR 0314096 (corresponding to U.S. Patent Publication 2005/0217157). Safety guards and means of locking in position allow angular indexing of the position of the support base and prevent any inadvertent operation on the board holder or panel holder.

The instructions for use that are specific to the invention are described below.

The board holder or panel holder (10) comprises a long carrying arm (10*a*) made with one or two associated hollow bars, a lower bar (10*a*1) and an upper bar (10*a*2) of considerable length and square or rectangular cross section with widthwise cross pieces (10*c*) fixed by welding or some other process and its ends having sliding T-shaped extensions (10*d*) the position of which can be adjusted depending on the length of the boards or panels to be loaded and positioned. The extension capacity of the board holder or panel holder can therefore be adjusted and adapted to the desired dimensions. A graduated scale or reference marks (10*e*) are advantageously applied to the lower extension (10*d*) equivalent to the length sizes of the accommodated boards or panels. A means of locking in position (10*f*1) of the pin type is provided on the lower hollow bar (10*b*1) in order to set the positioning of the corresponding extension. In addition, on the upper hollow bar (10*a*2) there is a screw (10*f*2) for locking the corresponding extension in position.

According to an additional characteristic of the invention, the board holder (10) accommodates, on its long carrying arm and in the middle section of the latter, a means of gripping in the form of handlebars (12) provided with control handles (13-14), means of control (23) to lock or unlock the articulating device. The handlebars are easily accessed and operated by the operator who, with two controls on the right and the left, can bring the board holder into a vertical, horizontal or intermediate position as required. Said handlebars are fixed by welding or some other process.

The lower part of the lower base (10*a*3) of the carrying arm (10*a*) of the board holder has a circular swivel base (15) designed with a cut-away part (15*a*) and two notches (15*b*-15*c*) located in 90° opposition to each other. The swivel base is joined to the carrying arm of the board holder by welding. In addition, on the upper surface of the support base (9) there is a retention disc (16) with a screw (17) and the means of running (18) of the swivel base, this assembly being attached to the tilting support base (9) with the associated side pieces (9*b*-9*c*). In the lowered position, this assembly rests up against the upper end (1*a*1) of the telescopic element (1*a*) that emerges from the mast (1) first.

On the sides of said side pieces, there is a swivel limit stop (19) that is joined to one of the side pieces (9*b*), this limit stop protruding above the side piece and facing the cut-away part (15*a*) on the swivel base. On the other side, the other side piece (9*c*) receives means of locking (20) capable of cooperating with one of the notches (15*b*-15*c*) formed on the swivel base. For this purpose, it has a receptacle (20*a*) welded to the adjacent side piece. Said receptacle has only one open end and accommodates a finger (20) actuated in opposition to a return spring (22) mounted at the bottom of the receptacle. The end (21*a*) of said finger comes into contact with the lower surface of the swivel base when the notched part does not match up. When the notched part is opposite it, the action of the return means extends the finger partially from its receptacle placing it opposite one of the notches (15*b*-15*c*). In practice, said locking finger is designed with a shouldered internal cavity which allows insertion of the end (23*a*) of a first means of control in the form of a pull cable (23), said end accommodating a limit stop means (24) that comes into contact with the bottom of the shouldered part. Said pull cable (23) is connected to aforementioned handlebars (12) through the relevant control handle (13).

Thus, the action of control handle (13) makes it possible to retract the cable (23) and pull locking finger (21) in, thus disengaging the corresponding notch (15*b*-15*c*) of the swivel base. It is apparent that said locking finger controls and allows or prevents 90° rotation of the board holder or panel holder in order to tilt it so that it is horizontal or vertical relative to the support base (9).

Also, said support base (9) is oriented relative to fixed section (8) that protrudes as an extension of the mast (1) of the appliance. The side pieces (9*b*-9*c*) of said support base designed with oblong slots (9*b*1-9*c*1) allow articulation relative to a connecting shaft (7) that passes through said fixed section. The latter comprises, as stated in Patent Application FR 0314096 (corresponding to U.S. Patent Publication 2005/0217157), a retractable finger (25) that fits into and positions itself in the component parts of the oblong slot and is itself associated with a second means of control of the pull cable type (26) one end (26*a*) of which goes directly to the second control handle (14) on the handlebar whilst the other end is attached (26*b*) to the rear part of said finger (25). Because of this it is easy to understand that actuating the corresponding handle (14) makes it possible to locate the finger in the corresponding part of the oblong slot (9*b*1) thus enabling tilting and locking of the support base in position.

In other words, the operator can, by grasping the handlebars and actuating the two handles (13-14) and their pull cable control, position the board holder or panel holder as he or she wishes in the loading or unloading plane, horizontally, vertically or in an intermediate position. This implementation of the invention is an extremely convenient method of handling and is completely safe.

According to another feature of the invention, there is a device for adjusting the height of the board holder or panel holder in accordance with the length dimension of the boards or panels. In fact, with regard to the positions that the board holder or panel holder is expected to assume, slanting, horizontal or vertical, anything that obstructs its tilting must be avoided. As stated earlier, the structure and one of the extensions of the board holder are designed with a graduated scale and reference marks (10*e*) which give the length of the board or panel to be fitted. This can be, for instance, 2 meters, 2.40 meters, 2.60 meters, 3 meters or more. Swiveling of the board holder before it is tilted into the vertical must therefore take into account this dimension. To achieve this, the upper tube on which the horizontal fixed section (8) that swivelingly accommodates the support base (9) is fixed, is designed with a bearing surface (27) or equivalent that receives the end of a means of measuring (28) that can be unwound. The latter is, for instance, a tape measure, the case of which is permanently mounted in a housing (29) on the surface of the external gear case that accommodates the telescopic elements of the mast. Alternatively, it can be a gauge. It is apparent that it is sufficient to transpose the dimension read off by reading the graduated scale (10*e*) on the board holder to the above-mentioned means of measuring (28). Control of extension of the telescopic elements by winch (3) causes deployment of the upper telescopic element, thereby actuating unwinding of the graduated tape of the means of measuring. This unwinding will therefore be established accurately with the additional markings that correspond to the lengths of the boards or panels. Said reference marks therefore make it possible to establish the length by which the telescopic element (1*a*) of mast (1) has to be elevated in order to allow sufficient height and enable 90° slewing before tilting the board holder or panel holder vertically. One means of measuring has been described but others offering equivalent functionality can be used.

The lifting appliance thus designed is extremely practical for the operator to use. The appliance thus described is used as follows to fit boards or panels in a vertical position:

The appliance is first of all immobilised.

The length of the board holder or panel holder is adjusted depending on the dimension of the board or panel to be picked up.

The operator uses the handlebars (12) to actuate the handle (13) for controlling and releasing positioning lock (20) to allow tilting of the board holder to bring it into a horizontal position.

In this configuration, one of the ends (15*a*) of swivel base (15) which is attached to the board holder is up against the limit stop on the support base and immobilised because positioning lock (21) is engaged in one of the notches (15*a*-15*b*).

The board or panel is loaded.

In order to offer up the board or panel, the operator adjusts the support base of the board holder in its upper position depending on the length of the board or panel. Actuating the winch causes upward movement of the upper telescopic element and unwinding of the means of measuring as far as the desired reference mark equivalent to the length of the board or panel.

The operator uses the handlebars to actuate control handle (13) to release positioning lock (20) in order to swivel the board holder or panel holder to 90°. The latter is moved towards the surface on which it will be fitted. The operator then uses handle (14) which allows tilting of the support base and pushes the materials handling and lifting appliance (A) in order to keep the lower part of the board in contact with the partition wall until it is vertical. The board can then be fixed to the partition wall.

All these operations are therefore controlled very easily and only one operator is required.

The advantages of the present invention are apparent, the simplicity of the control device and its great ease of handling being emphasised in particular. Height adjustments are also easy using means of quick read-out and checking in order to adapt the position of the board holder or panel holder depending on the dimensions of the boards or panels to be fitted.

The invention claimed is:

1. A materials handling and lifting appliance for a board or panel comprising:

telescopic elements mounted in a mast;

a tube mounted to at least one of the telescopic elements;

a horizontal bar mounted to the tube;

a board or panel holder having adjustable length carrying arms;

an articulating device rotatably mounted to the horizontal bar, said articulating device comprising:

a support base having an upper wall;

means for rotatably mounting the board or panel holder to the upper wall of the support base wherein the board or panel holder is positionable into a plurality of positions;

a first locking device adapted to limit the rotation of the board or panel holder; and a second locking device adapted to limit the rotation of the articulating device;

wherein the board or panel holder comprises a pair of handlebars adapted to manually rotate the articulating device and rotate the board or panel holder, the handlebars having control handles adapted to lock and unlock the first locking device and the second locking device on the articulating device.

2. Appliance as claimed in claim 1, wherein the handlebars are joined to a middle part of the carrying arms by welding.

3. Appliance as claimed in claim 1, wherein the means for rotatably mounting the board or panel holder to the upper wall of the support base comprises a circular swivel base mounted to the carrying arms, the circular swivel base having a cut-away part and two notches, the two notches located in 90° opposition to each other.

4. Appliance as claimed in claim 3, wherein the support base includes side pieces and a swivel limit stop mounted to one of the side pieces, the swivel limit stop protruding above the said one of the side pieces and adapted to engage the cut-away part of the swivel base, and wherein the first locking device is mounted on the other of said side pieces, wherein the first locking device is adapted to engage one of the two notches of the swivel base.

5. Appliance as claimed in claim 4, wherein the first locking device comprises a receptacle, wherein said receptacle having a spring-actuated finger adapted to engage a notch in one of the side pieces.

6. Appliance as claimed in claim 5, wherein the spring-actuated finger has a shouldered internal cavity adapted to receive a pull cable connected to one of the control handles.

7. Appliance as claimed in claim 3, wherein the support base includes side pieces having oblong slots adapted to receive a retractable finger of the second locking device said retractable finger adapted to receive a pull cable connected to one of the control handles.

8. Appliance as claimed in claim 1, wherein the adjustable length carrying arms include reference marks that indicate dimensions.

9. Appliance as claimed in claim 3, wherein the swivel base is mounted to the upper wall of the support base by a retention disc and a screw.

10. Appliance as claimed in claim 1, wherein the telescopic elements comprise an upper telescopic element, and wherein the upper telescopic element includes a bearing surface adapted to receive a means of measuring that can be unwound.

11. Appliance as claimed in claim 10, wherein the means of measuring is a tape measure mounted in a housing.

12. Appliance as claimed in claim 1, wherein the pair of handlebars adapted to manually rotate the articulating device and rotate the board or panel holder comprises a pair of handlebars adapted to permit orientation of the board or panel holder in substantially any horizontal, vertical, or intermediate orientation.

* * * * *